US006015320A

United States Patent [19]

Nanami

[11] Patent Number: 6,015,320

[45] **Date of Patent: *Jan. 18, 2000**

[54] OIL COOLER FOR WATERCRAFT

[75] Inventor: Masayoshi Nanami, Shizuoka, Japan

[73] Assignee: Yamaha Hatsudoki Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/867,173

[22] Filed: Jun. 2, 1997

[30] Foreign Application Priority Data

May 31, 1996 [JP] Japan ..... 8-161116

[51] Int. Cl.[7] ..... B63H 21/10

[52] U.S. Cl. ..... 440/88; 114/270; 123/196 R

[58] Field of Search ..... 440/88, 89; 114/270; 123/196 R, 196 AB

[56] References Cited

U.S. PATENT DOCUMENTS

| | | | |
|---|---|---|---|
| 4,984,528 | 1/1991 | Kobayashi | 114/270 |
| 5,366,397 | 11/1994 | Suganuma et al. | 440/39 |
| 5,507,673 | 4/1996 | Boggia | 440/88 |
| 5,647,315 | 7/1997 | Saito | 123/196 AB |
| 5,839,930 | 11/1998 | Nanami et al. | 440/88 |

*Primary Examiner*—Jesus D. Sotelo

*Attorney, Agent, or Firm*—Knobbe, Martens, Olson & Bear, LLP

[57] ABSTRACT

A lubrication cooling system for an internal combustion engine positioned within an engine compartment of a personal watercraft for powering a water propulsion unit thereof, is disclosed. The lubrication cooling system lowers the temperature of the lubrication for the internal combustion engine of a personal watercraft. Preferably, the lubrication cooling system incorporates cooling the lubrication by introducing the lubrication cooler to a fluid such as forced air or ambient water.

41 Claims, 11 Drawing Sheets

OIL COOLER FOR WATERCRAFT

FIELD OF THE INVENTION

The present invention relates to a cooling system for a lubricating system of an internal combustion engine. More particularly, the present invention relates to a cooling system for a lubricating system for an engine for use in powering a water propulsion device of a watercraft.

BACKGROUND OF THE INVENTION

Personal watercrafts have become very popular in recent years. An enthusiasm for competition has grown with this popularity, and as a result personal watercrafts have become increasingly faster. Many personal watercrafts today are capable of traveling at speeds above 60 mph. To attain such speeds, such watercrafts are typically driven by high power output motors.

Typically, these high output motors are of the internal combustion type and are lubricated with a motor oil as known in the art. Running a motor at a very high output, however, generates a great deal of heat particularly in the lubrication system of the motor. If the motor is continually run in this manner the lubricant's viscosity will break down and it will not be able to cool the engine properly. The viscosity break down could result in the engine overheating and eventually in full engine seizure.

It is therefore desired to provide a watercraft with a high output engine having a lubricating system which will not overheat and will provide proper lubrication for the engine.

SUMMARY OF THE INVENTION

In accordance with the present invention there is provided a lubrication cooling system for a high output internal combustion engine particularly suited to watercraft applications. The watercraft is preferably of the personal watercraft variety, having an enclosed engine compartment which is accessible by exposing a maintenance opening under a seat.

The lubrication system includes a lubricant reservoir, means for delivering lubricant to the lubrication system, such as a pump, and a lubrication cooler mechanism comprising a heat exchanger cooled by either forced air or water. In a preferred embodiment of the present invention the engine includes a lubrication collector at a bottom thereof, with a lubricant reservoir mounted in proximity to the engine. In this arrangement, lubricant is supplied from the reservoir through a supply line to a port in the engine. The lubricant passes through the engine to the collector and then flows through the lubrication cooler where it is cooled, as is known in the art. After the lubricant is cooled, it flows back to the reservoir.

In two other embodiments of the present invention, the lubrication cooler is located in the front of the watercraft advantageously in a position to be air cooled by the air forced through an air intake structure located on the front of the watercraft.

In another embodiment, the lubrication cooler is located in the engine compartment within a water jacket. The water jacket is cooled by a water supply from the propulsion unit. In a similar embodiment, the return water is pumped from the water jacket containing the lubrication cooler into a cooling system for the engine.

In an additional embodiment, the lubrication cooler is contoured into a ride plate of a hull of the watercraft and thus is water cooled. In a similar embodiment, the lubrication cooler is located on the inside of the engine compartment with one side exposed to a water inlet area whereby the lubricant is cooled from the ambient water passing thereby.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
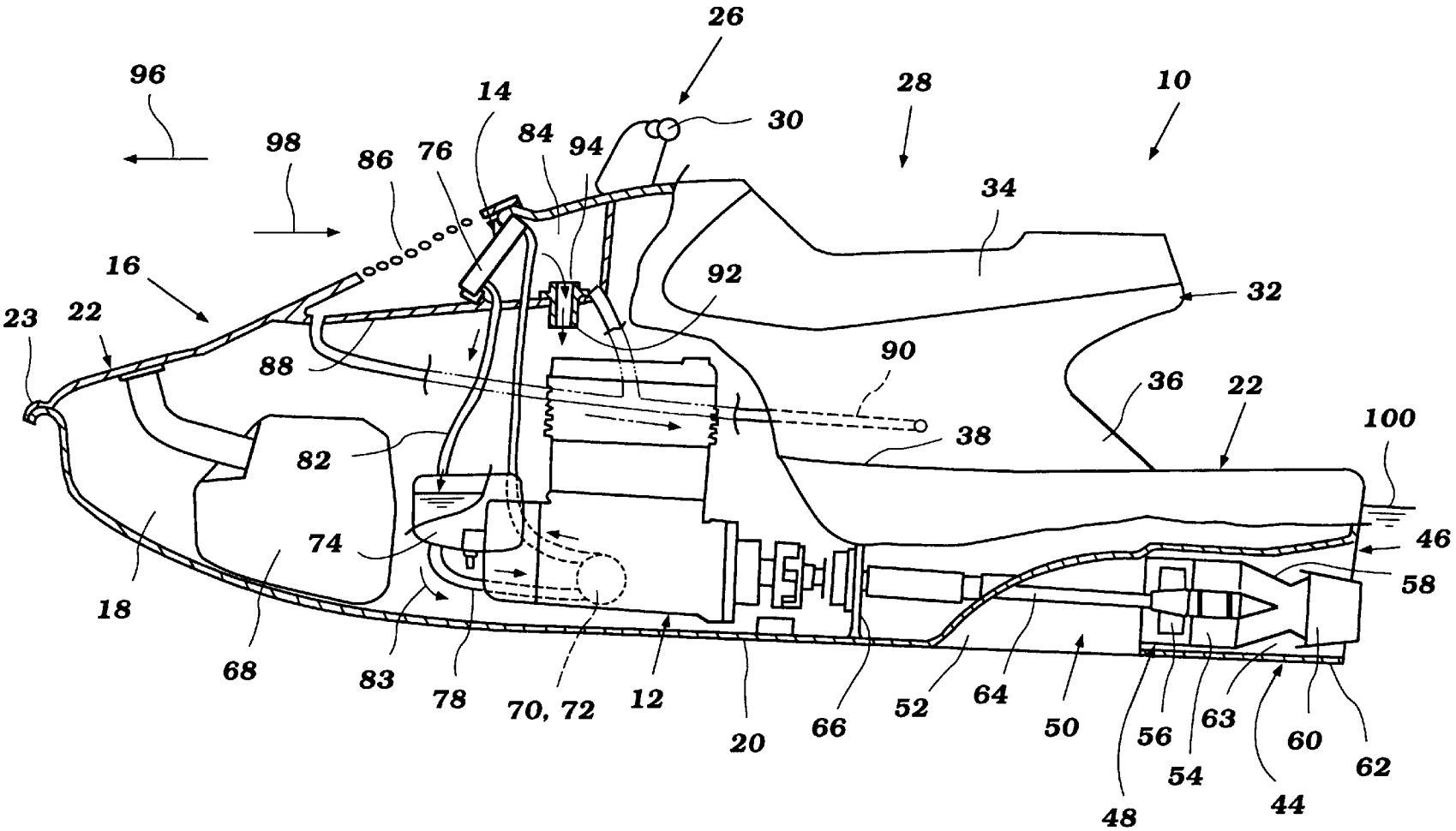
FIG. 1 is a partial sectional side view of a personal watercraft with a lubrication cooling system configured in accordance with a preferred embodiment of the present invention.
Figure 2:
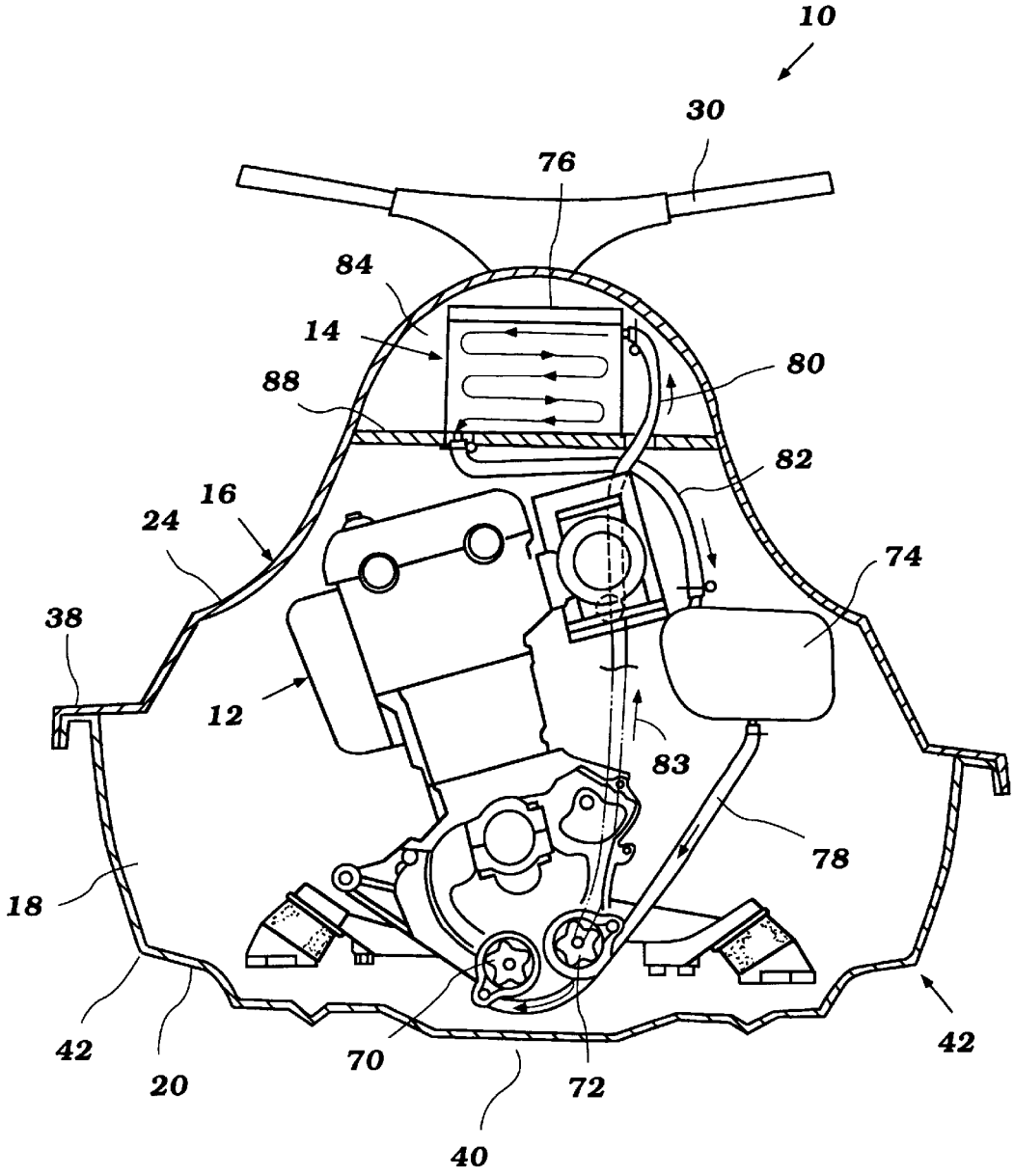
FIG. 2 is a cross-sectional view of the watercraft illustrated in FIG. 1 taken along line 2—2, with a schematic illustration of a lubricant flow path through the lubrication cooling system.

FIGS. 1 and 2 illustrate a personal watercraft 10 which includes an arrangement of an engine 12 and a lubrication cooling system 14 within a hull 16 of the watercraft 10 in accordance with a preferred embodiment of the present invention. The engine 12 and lubrication cooling system 14 are arranged within the hull 16 in a manner which enhances the cooling of the engine lubrication. As a result, the cooling of the lubrication results in a lower probability of lubrication viscosity break down thus reducing the chance of complete engine seizure.

Although the present invention is illustrated in connection with a personal watercraft, it is understood that the lubrication cooling system 14 can be used with other types of watercraft as well. For example, but without limitation, the present lubrication cooling system 14 can be used with small jet boats and the like.

Before describing the lubrication cooling system 14 within the watercraft 10, an exemplary personal watercraft 10 will first be described in general detail to assist the reader's understanding of the environment of use. The hull 16 of the watercraft 10 is formed by a lower hull section 20 and an upper deck section 22. The hull sections 20, 22 are formed from a suitable material such as, for example, a molded fiberglass reinforced resin. The lower hull section 20 and the upper deck section 22 are fixed to each other around the gunnel 23 in any suitable manner.

As viewed in the direction from the bow to the stem of the watercraft, the upper deck section 22 includes a bow portion 24, a control mast 26 and a rider's area 28. The bow portion 24 slopes upwardly toward the control mast 26 and includes at least one air duct 92 through which air can enter the hull 16. Typically, a cover extends over the air duct 92 to inhibit an influx of water into the hull 16, as described below. The air duct 92 extends from above the deck 22 into the engine compartment 18.

The control mast 26 extends upward from the bow portion 24 and supports a handlebar assembly 30. The handlebar assembly 30 controls the steering of the watercraft 10 in a conventional manner. The handlebar assembly 30 also carries a variety of controls of the watercraft 10, such as, for example, a throttle control, a start switch and a lanyard switch.

The rider's area 28 lies behind the control mast 26 and includes a seat assembly 32. In the illustrated embodiment, the seat assembly 32 has a longitudinally extending straddle-type shape which may be straddled by an operator and by at least one or two passengers. The seat assembly 32, at least in principal part, is formed by a seat cushion 34 supported by a raised pedestal 36. The raised pedestal 36 forms a portion of the upper deck 22 and has an elongated shape that extends longitudinally along the center of the watercraft 10. The seat cushion 34 desirably is removably attached to a top surface of the pedestal 36 by one or more latching mechanisms (not shown) and covers the entire upper end of the pedestal 36 for rider and passenger comfort.

An access opening (not shown) is located on an upper surface of the pedestal 36. The access opening opens into an engine compartment 18 formed within the hull 16. The seat cushion 34 normally covers and seals closed the access opening. When the seat cushion 34 is removed, the engine compartment 18 of the hull 12 is accessible through the access opening.

The upper deck section 22 of the hull 12 advantageously includes a pair of level planes 38 positioned on opposite sides of the aft end of the upper deck assembly 22. The level planes 38 define a pair of foot areas that extend generally longitudinally and parallel to the sides of the pedestal 36. In this position, the operator and any passengers sitting on the seat assembly 32 can place their feet on the foot areas during normal operation of the personal watercraft 10. A non-slip (e.g., rubber) mat desirably covers the foot areas to provide increased grip and traction for the operator and the passengers.

The lower hull portion 20 principally defines the engine compartment 18. Except for the air ducts 92, the engine compartment is normally substantially sealed so as to enclose an engine 18 of the watercraft 10 from the body of water in which the watercraft 10 is operated.

The lower hull 20 is designed such that the watercraft 10 planes or rides on a minimum surface area of the aft end of the lower hull 20 in order to optimize the speed and handling of the watercraft 10 when up on plane. For this purpose, as seen in FIG. 2, the lower hull section generally has a V-shaped configuration formed by a pair of inclined sections that extend outwardly from a keel line 40 to outer chines 42 at a dead rise angle. The inclined sections extend longitudinally from the bow toward a transom 46 of the lower hull 20 and, as seen in FIG. 2, extend outwardly to side walls of the lower hull 20. The side walls are generally flat and straight near the stern of the lower hull and smoothly blend towards the longitudinal center of the watercraft at the bow. The lines of intersection between the inclined section and the corresponding side wall form the outer chines 42 of the lower hull section 20. The lower hull 20 can also include additional chines between the keel line 40 and the outer chines 42 for improved handling, as known in the art.

Toward the transom 46 of the watercraft, the incline sections of the lower hull extends outwardly from a recessed channel or tunnel 44 that extends upward toward the upper deck portion 22. The tunnel 44 has a generally parallelepiped shape and opens through the transom 46 of the watercraft 10.

In the illustrated embodiment, a jet pump unit 48 propels the watercraft 10. The jet pump unit 48 is mounted within the tunnel 44 formed on the underside of the lower hull section 20 by a plurality of bolts. An intake duct 50 extends between the jet pump unit 48 and an inlet opening 52 that opens into a gullet. The duct 50 leads to an impeller housing 54 in which the impeller 56 of the jet pump 48 operates. The portion of the impeller housing 54, which acts as a pressurization chamber, delivers the pressurized water flow to a discharge nozzle housing 58.

A steering nozzle 60 is supported at the downstream end of the discharge nozzle 58 by a pair of vertically extending pivot pins. In an exemplary embodiment, the steering nozzle 60 has an integral lever on one side that is coupled to the handlebar assembly 30 through, for example, a bowden-wire actuator, as known in the art. In this manner, the operator of the watercraft can move the steering nozzle 60 to effect directional changes of the watercraft 10.

A ride plate 62 covers a portion of the tunnel 44 behind the inlet opening 52 to enclose the jet pump unit 48 within the tunnel 44. In this manner, the lower opening of the tunnel 44 is closed to provide a planing surface for the watercraft. A pump chamber 63 then is defined within the tunnel section covered by the ride plate 62.

An impeller shaft 64 supports the impeller 56 within the impeller housing 54. The aft end of the impeller shaft 64 is suitable supported and journalled within the compression chamber of the housing 54 in a known manner. The impeller shaft 64 extends in the forward direction through a bulkhead 66. A protective casing surrounds a portion of the impeller shaft 64 that lies forward of the intake gullet 50.

The engine 12 powers the impeller shaft 64. The engine 12 is positioned within the engine compartment 18 and is mounted primarily beneath the control mast 26. Vibration absorbing engine mounts secure the engine 12 to the lower hull 20. The engine 12 is mounted in approximately a central portion of the watercraft 10.

A fuel supply system delivers fuel to the engine 12 as is known in the art. The fuel supply system includes a fuel tank 68 located in front of the engine 12. Although not illustrated, at least one pump desirably delivers fuel from the fuel tank 68 to the engine 12 through one or more fuel lines.

The engine 12 desirably is an internal combustion engine of a known four-stroke variety. Because the engine 12 is conventional, the internal details of the engine 12 are not believed necessary for an understanding of the present lubrication cooling system 14.

In the illustrated embodiment, the lubrication cooling system 14 includes a pair of pumps 70, 72, a reservoir 74, and a lubrication cooler 76. The first pump 70 draws lubricant from the reservoir 74 through line 78 and pumps it through lubricant galleries in the engine 12 to lubricate the engine 12 in a conventional manner. The lubricant then drains into a crankcase of the engine 12 where the second pump 72 delivers the lubricant from the engine 12 to the lubrication cooler 76 through a delivery line 80. The lubricant then flows from the lubrication cooler 76, through a return line 82 to the reservoir 74. The arrows generally referenced by 83 illustrate the direction of the lubricant flow through the lubrication system 14.

While the lubricant is circulating through the lubrication system 14 described above, the lubrication cooler 76 desirably is exposed to a flow of an ambient cooling fluid supplied by a fluid delivery system for cooling the lubrication cooler 76. In the illustrated embodiment of FIG. 1, the lubrication cooler 76 is positioned within an air intake chamber 84 located in the bow portion 24 of the hull 16. The air intake chamber 84 is defined by: an intake grate 86, located on the bow portion 24 of the hull 16; a close-out panel 88, for separating the air intake chamber 84 from the engine compartment 18; a drain mechanism 90, for allowing any water entering the air intake chamber 84 to exit to the body of water in which the watercraft operates; and the engine compartment air duct 92, providing air into the engine compartment 18. An inlet end 94 of the air duct 92 desirably lies above both the front and back drain holes of the drain mechanism 90. In this manner, water is inhibited from entering the engine compartment 18 through the air duct 92.

During use of the watercraft 10, the watercraft 10 will travel in the direction of arrow 96. This will force air, in a direction indicated by arrow 98, through intake grate 86 and over lubrication cooler 76 thereby cooling the lubrication within the lubrication cooler 76. Also, during normal operation of the watercraft 10, water spray may enter into the air intake chamber 84, or water may enter the intake chamber 84 if the watercraft 10 is inverted or laid on its side. The water will exit the chamber 84 through drain mechanism 90 draining the water back to a body of water 100.

Figure 3:
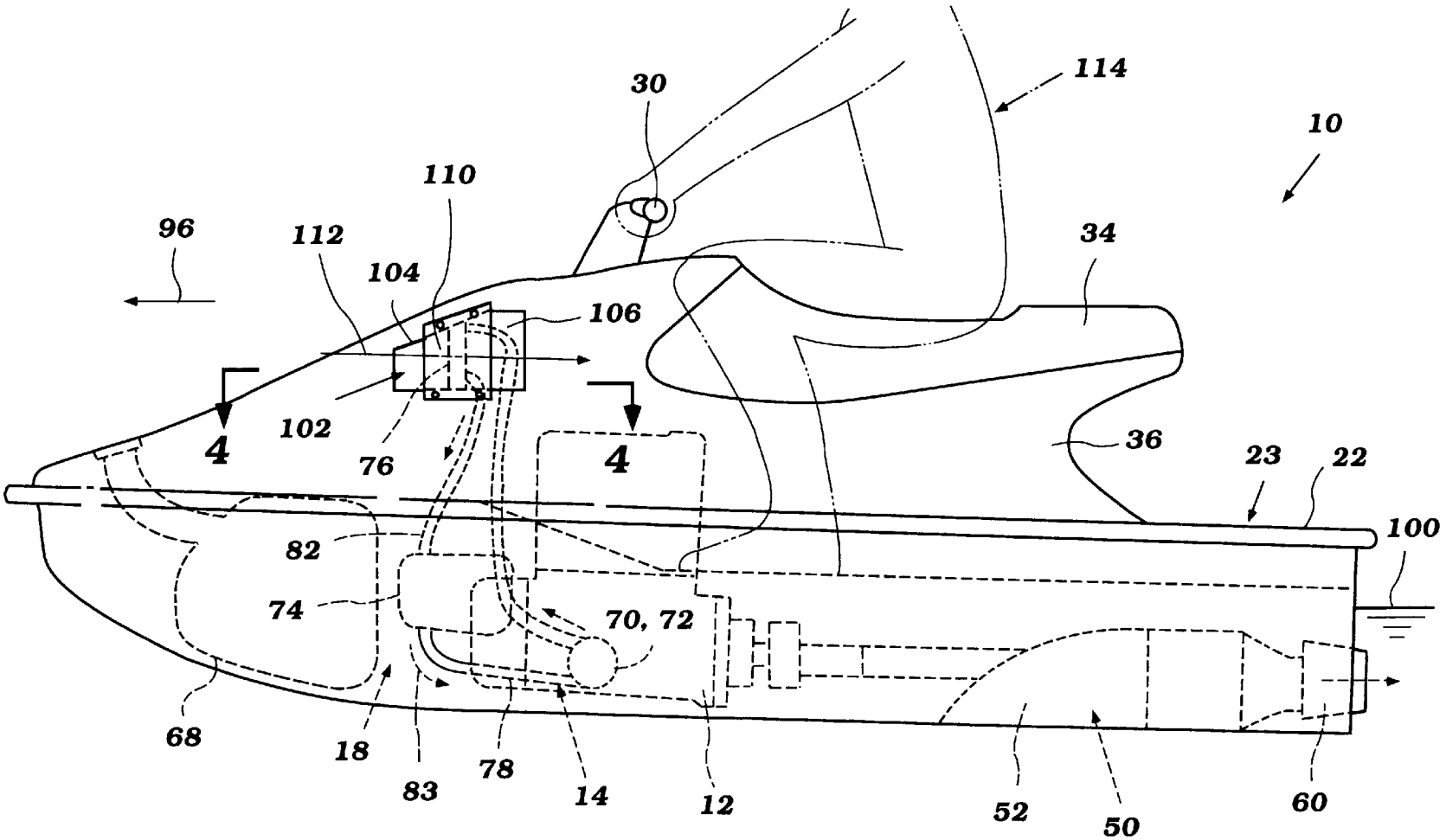
FIG. 3 is a side view of the watercraft with a lubrication cooling system in accordance with the another embodiment of the present invention with some of the internal components in phantom.
Figure 4:
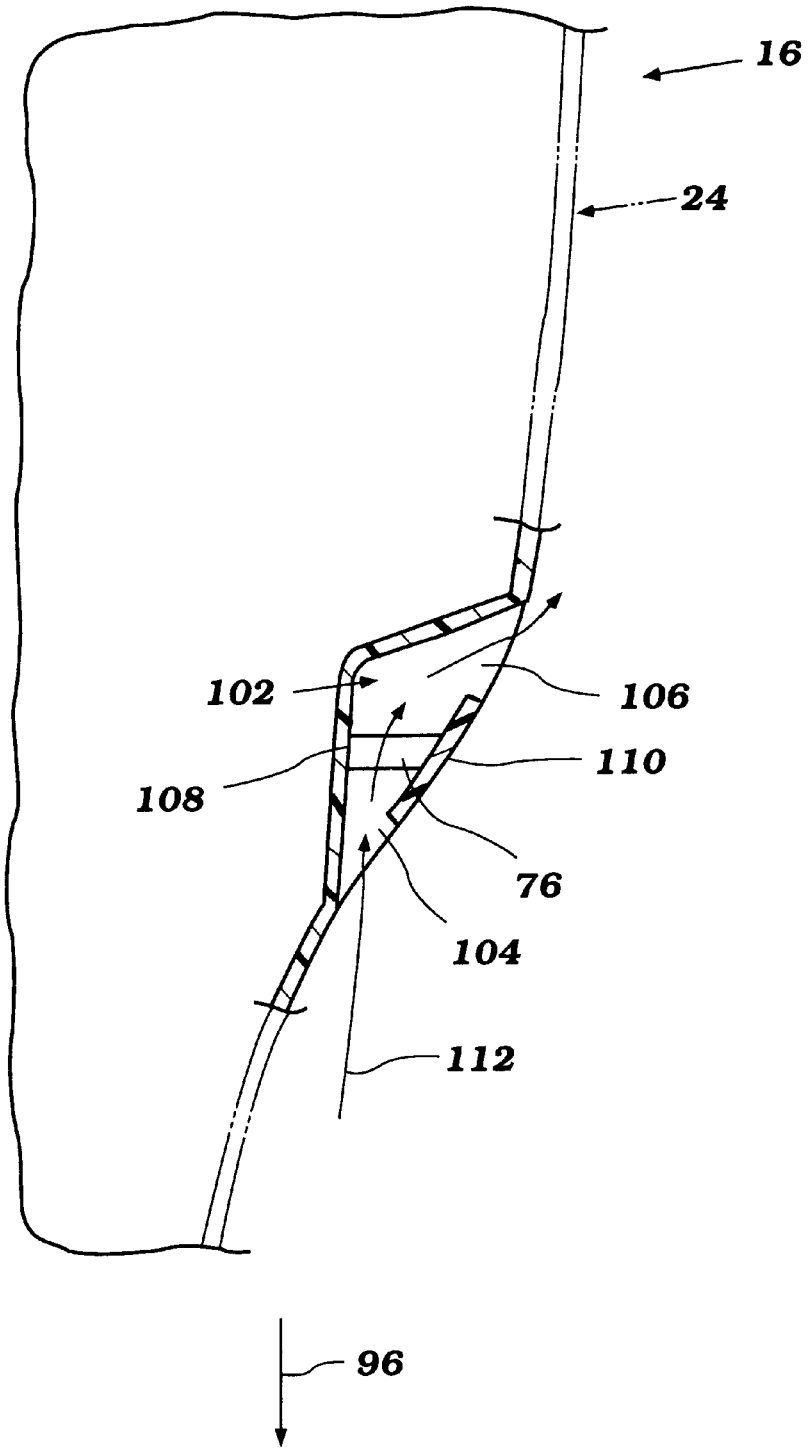
FIG. 4 is a cross-sectional view of the hull showing the orientation of the lubrication cooler of FIG. 3 as taken along line 4—4.

FIGS. 3 and 4 illustrate another embodiment of lubrication cooling system 14 within a small watercraft in accordance with a preferred embodiment of the present invention. The principal differences between the embodiment of FIGS. 1 and 2 and the embodiment of FIGS. 3 and 4 lie with the location of the lubrication cooler 76 within the bow portion 24 of the hull 16. Therefore, for ease of description, similar features are ascribed the same reference numerals used for corresponding elements from the embodiment of FIGS. 1 and 2. Unless otherwise indicated, the above description of similar components should be understood as applying equally to the following embodiment.

As with the first embodiment, while the lubricant is cycling through the system 14, described above, the lubrication cooler 76 cooperates with a fluid delivery system for cooling the lubrication cooler 76. In the embodiment as shown in FIGS. 3 and 4, the lubrication cooler 76, is positioned within a side mounted air intake chamber 102 of a portion of the bow 24 of the hull 16. The side mounted air intake chamber 102 is defined by: a generally front-facing air entrance 104, in the side of the bow 24 of the hull 16; a generally side-facing air egress 106, in the side of the bow 24 of the hull 16; a close-out panel 108, for separating the air intake chamber 102 from the engine compartment 18; and an exterior close-out panel 110 for securing the lubrication cooler 76 within the air intake chamber 102.

During use of the watercraft 10 by the operator 114, the watercraft 10 will travel in the direction of arrow 96. This will force air, in the direction indicated by arrow 112, through air entrance 104 and over lubrication cooler 76 thereby cooling the lubrication within the lubrication cooler 76. The air will exit the chamber 102 through air egress 106.

Figure 5:
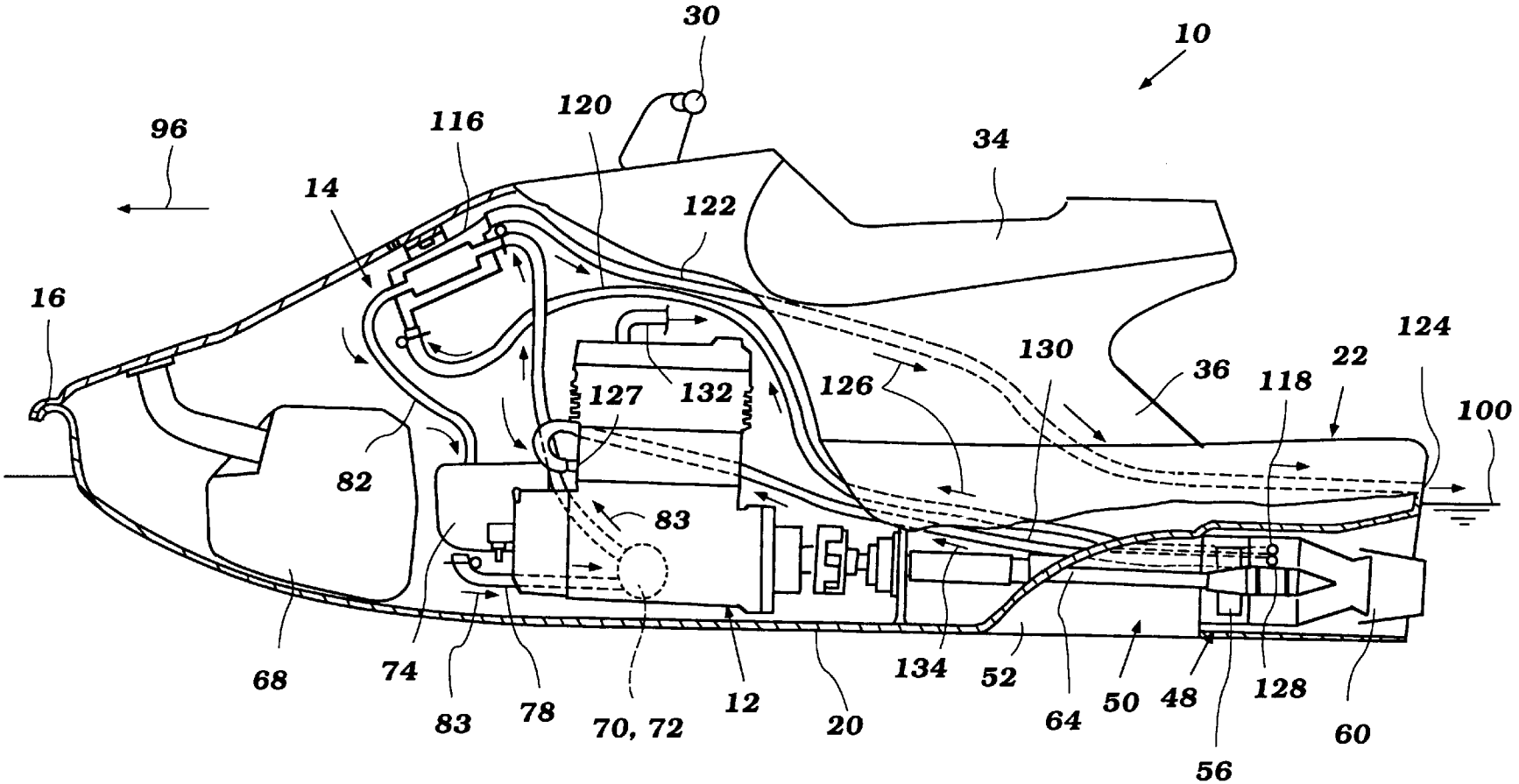
FIG. 5 is a partial-sectional side view of the personal watercraft with a lubrication cooling system configured in accordance with an additional embodiment of the present invention.
Figure 6:
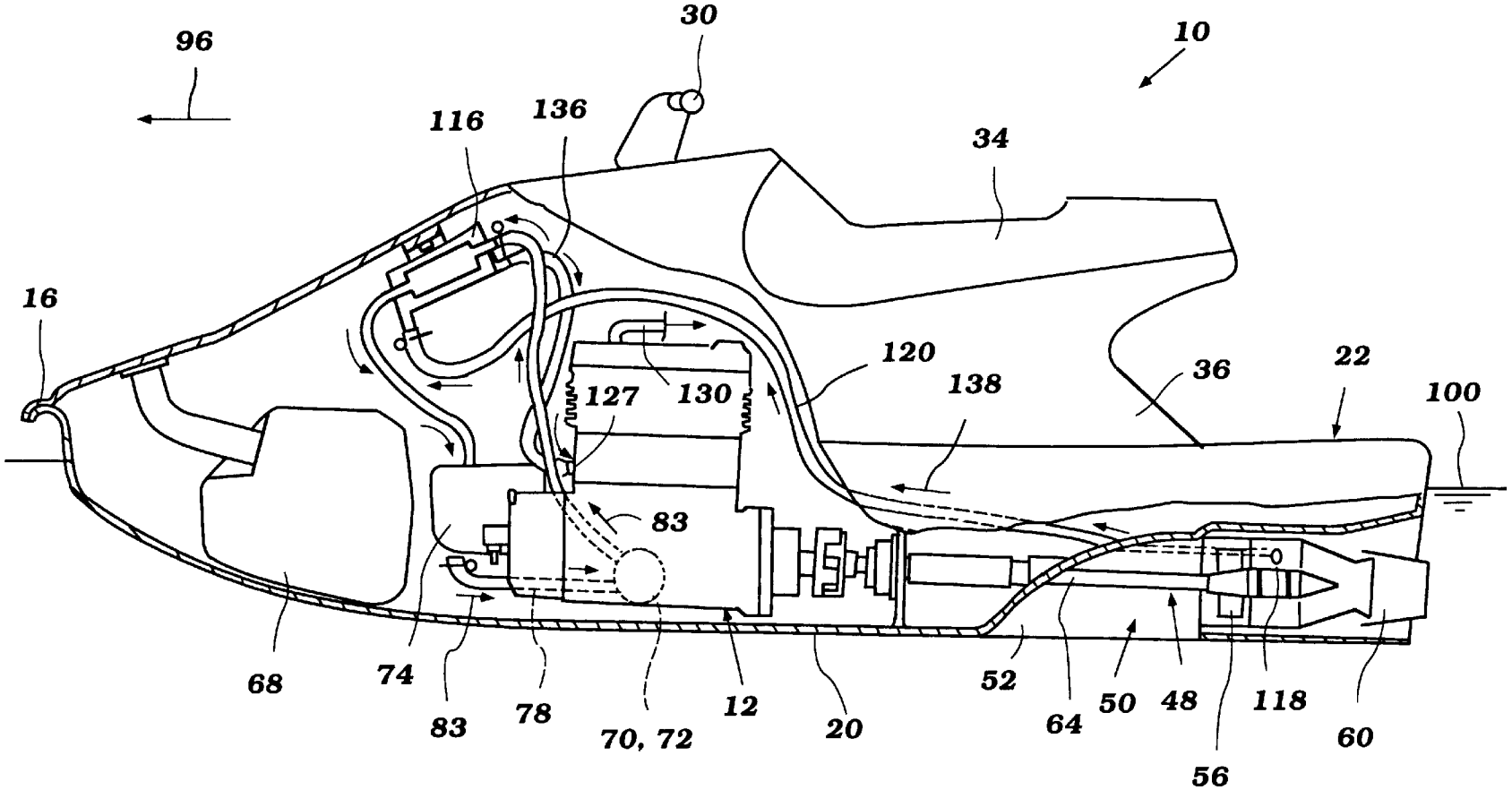
FIG. 6 is a partial cross-sectional side view of a personal watercraft with a lubrication cooling system configured in accordance with an additional embodiment of the present invention.

FIGS. 5 and 6 each illustrate another embodiment of lubrication cooling system 14 within a hull of a small watercraft in accordance with a preferred embodiment of the present invention. The principal differences between the embodiment of FIGS. 1 and 2 and the embodiments of FIGS. 5 and 6 lie with the arrangement and structure of the lubrication cooler 76. Therefore, for ease of description, similar features are ascribed the same reference numerals used for corresponding elements from the embodiment of FIGS. 1 and 2. Unless otherwise indicated, the above description of similar components should be understood as applying equally to the following embodiment.

As with the first embodiment, while the lubricant is cycling through the system 14, described above, a fluid delivery system provides a flow of cooling fluid adjacent to lubrication cooler 76 to cool the lubrication cooler 76. In the embodiments as shown in FIGS. 5 and 6, the lubrication cooler 76 is positioned within the engine compartment 18 of the hull 16. The lubrication cooler 76 also is located within a water jacket 116 mounted within the engine compartment 18 above the propulsion unit 48 of the watercraft 10. The water jacket 116 is provided water from a Venturi type hole 118 in the impeller housing 54 of the propulsion unit 48. The hole 118 opens into a line 120 to allow water to travel through the line 120 and into the water jacket 116 thus cooling the lubrication cooler 76. The water then exits the water jacket 116 through a return line 122 to be discharged to the body of water 100 at a port 124 on a transom of the watercraft hull 20.

The port 124 desirably lies at a lower position than the water jacket 116. By locating the hole 118 and the port 124 lower than the water jacket 116, water in the water jacket 116 will drain by gravity when the watercraft 10 is not in use. (The direction of flow of water for this operation is shown by the arrows 126.)

This embodiment also illustrates how the propulsion unit 48 can provide water to a port 127 of an engine cooling system to cool the engine 12. The water exits through a hole 128 in the impeller housing 54 and enters line 130 to deliver water to the engine cooling system in the engine 12. The water exits the engine cooling system through a line 132 and is discharged by conventional means. The direction of flow for this operation is indicated by the arrows generally labeled 134.

FIG. 6, like the previous embodiment, introduces the lubrication cooler 76 to a fluid delivery system for cooling the lubrication cooler 76. Like the embodiment of FIG. 5, the embodiment of FIG. 6 locates the lubrication cooler 76 within a water jacket 116 mounted within the engine compartment 18 of the watercraft 10. The water jacket 116 is provided water from a Venturi type hole 118 in the impeller housing 54 of the propulsion unit 48. The hole 118 allows water to travel through a hose 120 into the water jacket 116 thus cooling the lubrication cooler 76. The water then exits the water jacket 116 through a line 136 to an inlet port 127 an engine cooling system for cooling the engine 12. The water then exits the engine cooling system into line 130 and is discharged from the watercraft 10 in a known manner. The direction of flow of water for this operation is shown by the arrows 138.

Figure 7:
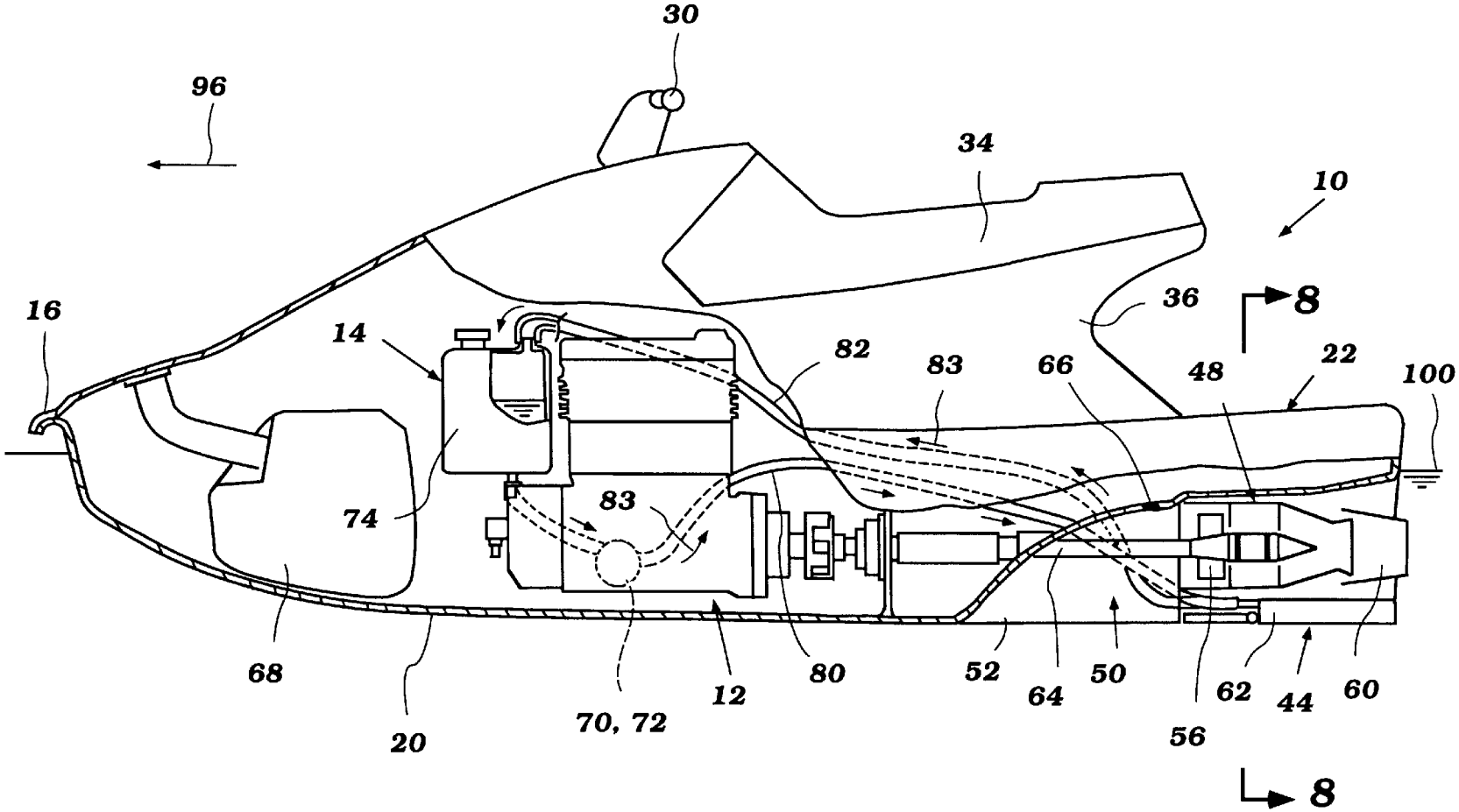
FIG. 7 is a partial cross-sectional side view of a personal watercraft with a lubrication cooling system configured in accordance with an additional embodiment of the present invention.
Figure 9:
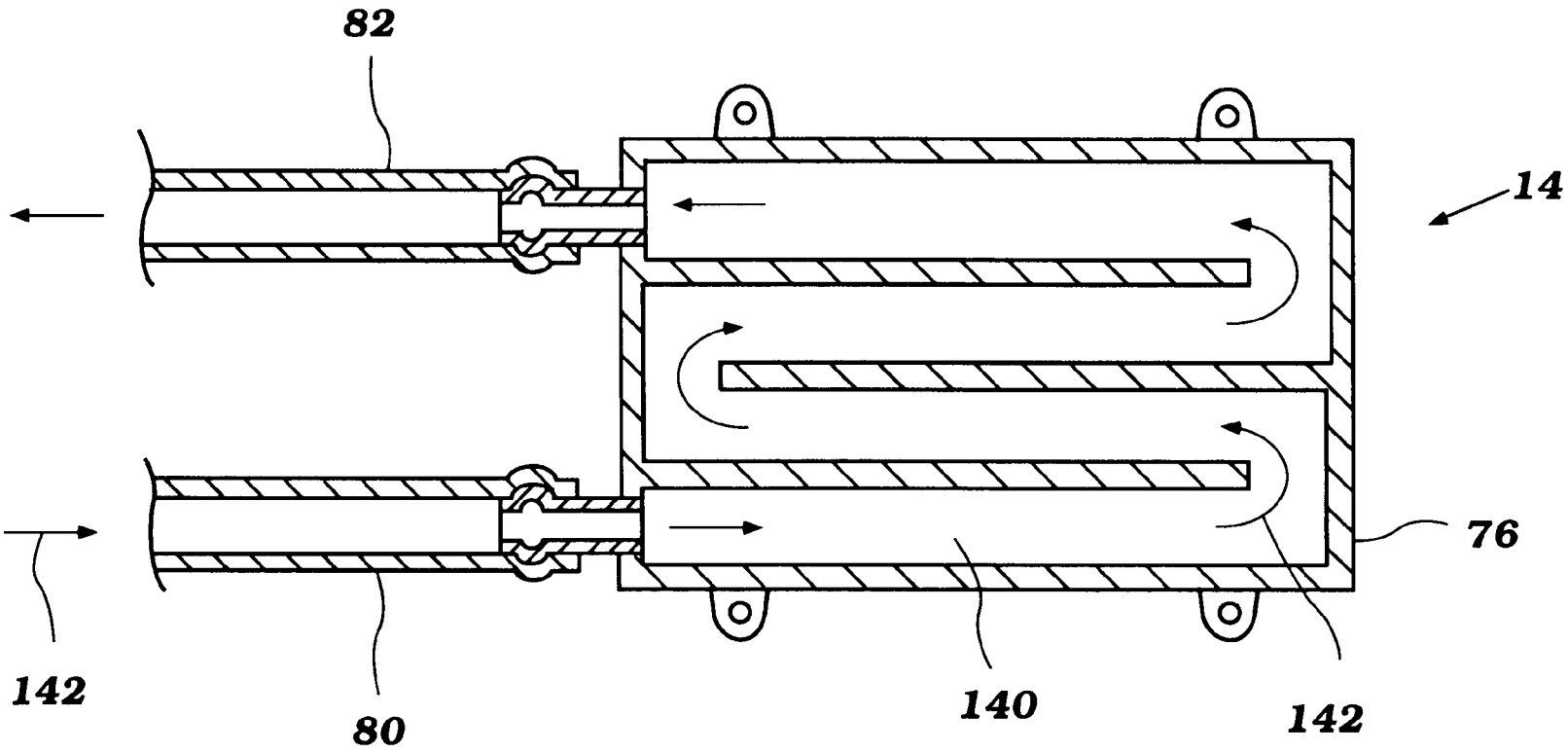
FIG. 9 is a cross-sectional view of the lubrication cooler of FIG. 8.
Figure 10:
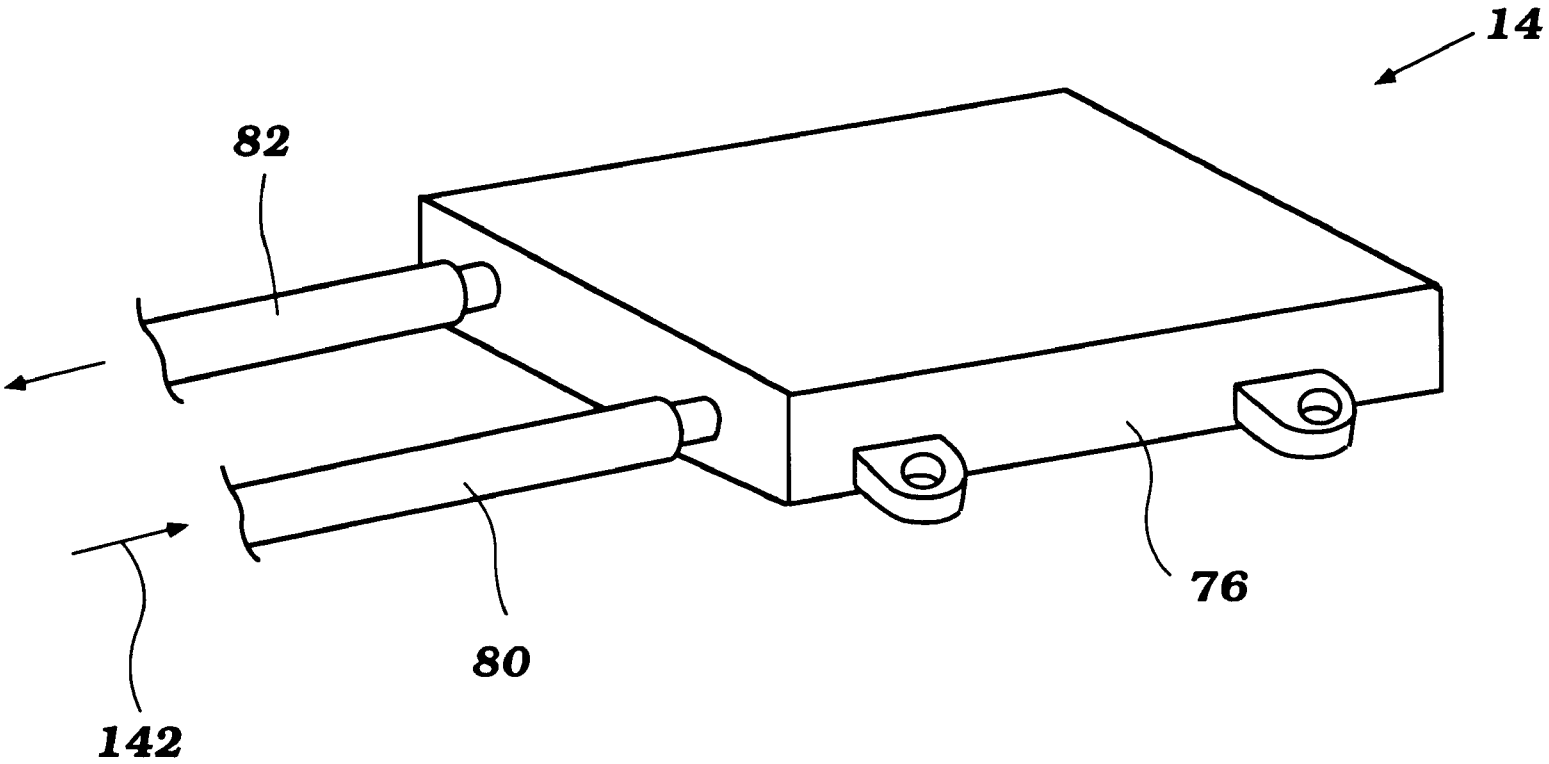
FIG. 10 is an isometric view of the lubrication cooler of FIG. 9.

FIGS. 7 and 10 illustrate another embodiment of lubrication cooling system 14 within a hull of a small watercraft in accordance with a preferred embodiment of the present invention. The principal differences between the embodiment of FIGS. 1 and 2 and the embodiments of FIGS. 7 through 10 lie with the location of the lubrication cooler 76 within the hull 16. Therefore, for ease of description, similar features are ascribed the same reference numerals used for corresponding elements from the embodiment of FIGS. 1 and 2. Unless otherwise indicated, the above description of similar components should be understood as applying equally to the following embodiment.

Figure 8:
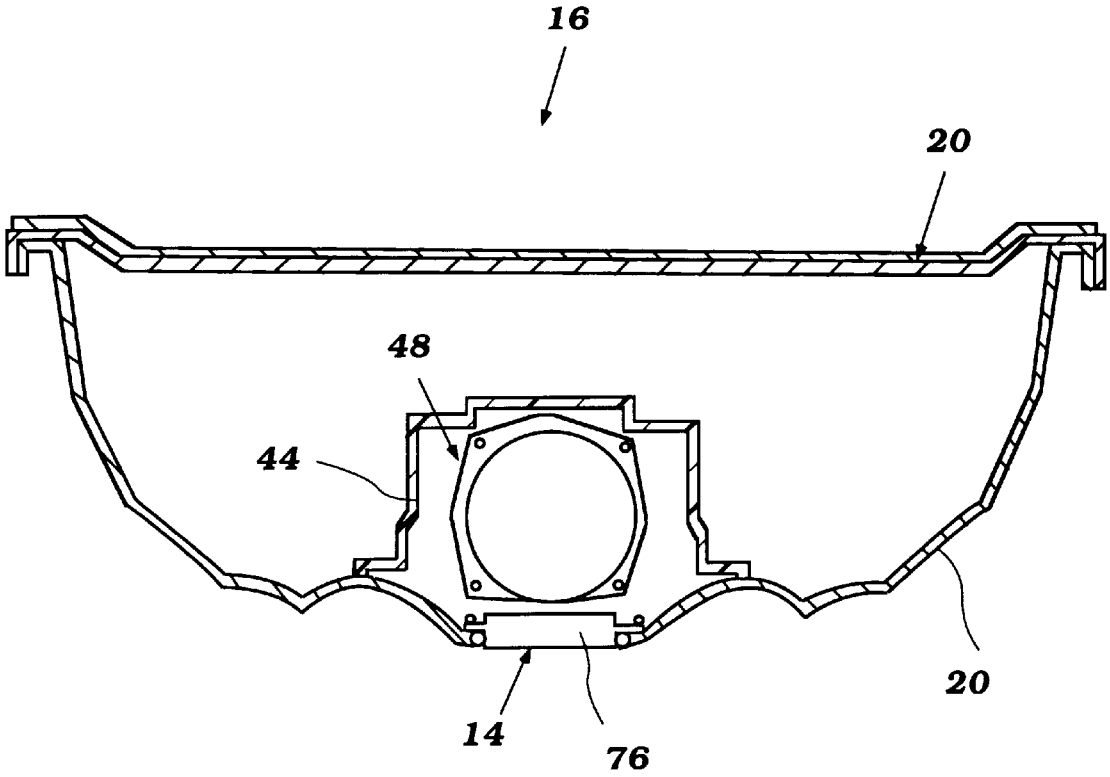
FIG. 8 is a cross-sectional view of the hull of a personal watercraft showing a lubrication cooler of the lubrication cooling system of FIG. 7 as taken through line 8—8.

In this embodiment, the lubrication cooler 76 is located within the tunnel 44 portion of the lower portion of the hull 20 near the propulsion unit 48. FIG. 8 shows a partial section of the lower portion of the hull 20 in the stern area of the watercraft 10. In this embodiment, the lubrication cooler 76 is integrally formed with the tunnel 44 of the hull 20. That is, a portion of the lubrication cooler completes a lower wall of the tunnel 44. By locating lubrication cooler 76 in this location it is exposed to the water 100, thereby cooling the lubrication cooler 76. The cooler 76 also functions as the ride plate 62. (See FIG. 1.)

FIGS. 9 and 10 show detailed views of the lubrication cooler 76. The lubricant enters the lubrication cooler 76 through line 80 then through the internal chamber 140 flowing in a direction indicated by arrow 142. The fluid exits the lubrication cooler 76 through line 82. The delivery line 80 is coupled to the pump 72 to receive lubricant from the engine 12 and the return line 82 is coupled to the reservoir 74.

Figures 11, 11A:
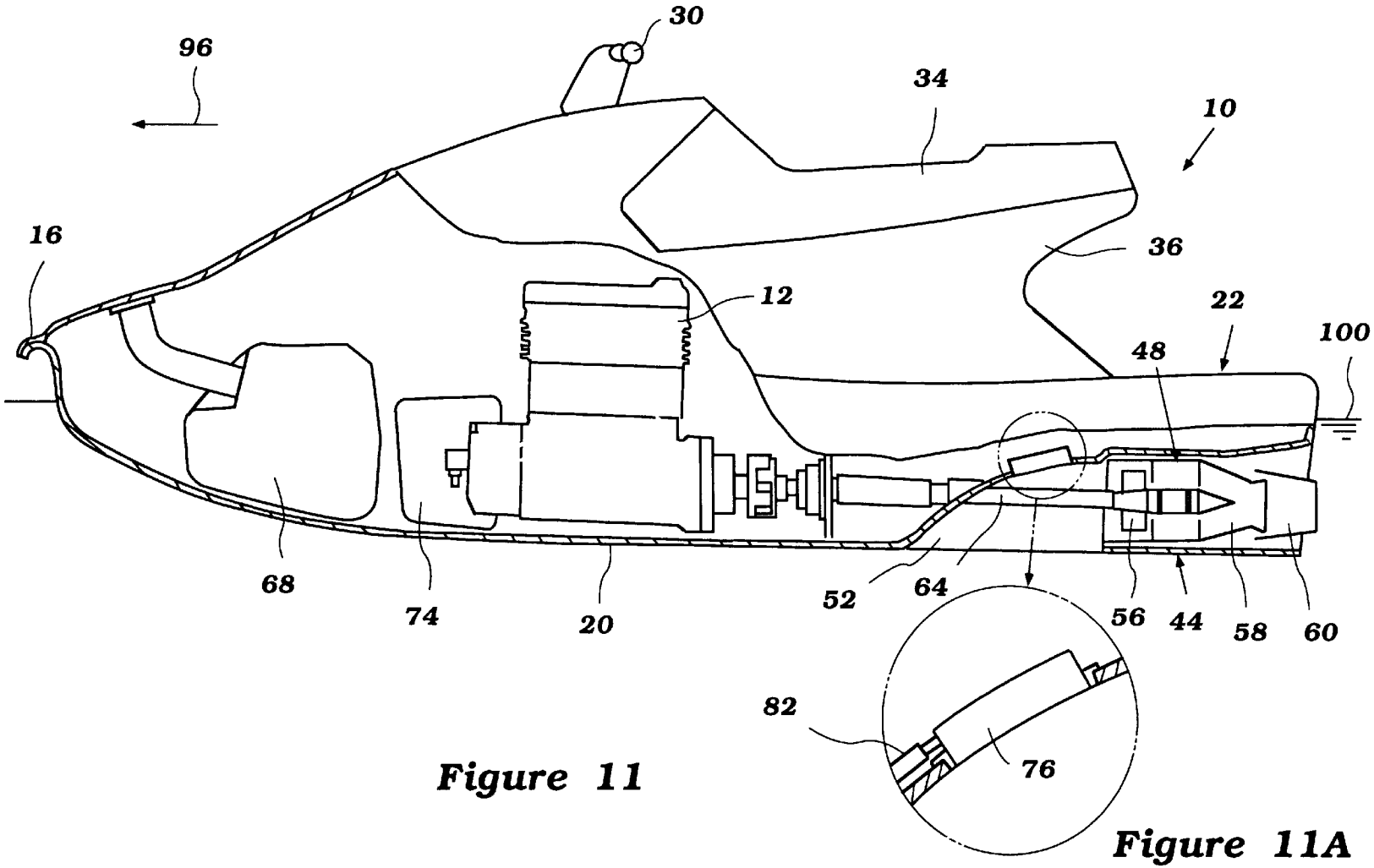
FIG. 11 is a partial-sectional view of a personal watercraft with a lubrication cooling system configured in accordance with another embodiment of the present invention.

FIG. 11 illustrates another embodiment of lubrication cooling system 14 within a hull of a small watercraft in accordance with another preferred embodiment of the present invention. The principal differences between the embodiment of FIG. 11 and the embodiments of FIGS. 7 and 8 lie with the location of the lubrication cooler 76 within the tunnel 44. Therefore, for ease of description, similar features are ascribed the same reference numerals used for corresponding elements from the embodiment of FIGS. 7 and 8. Unless otherwise indicated, the above description of similar components should be understood as applying equally to the following embodiment.

In this embodiment, the lubrication cooler 76 cooperates with another fluid delivery system for cooling the lubrication cooler 76. In this embodiment, the lubrication cooler 76 is located within a wall of the intake duct 50. The lubrication cooler 76 is formed integrally (i.e., a portion of the lubrication cooler completes the wall) with the intake duct so that a side of the lubrication cooler 76 is exposed to the water 100. This is shown in FIG. 11-A. With the lubrication cooler 76 in this location it is exposed to the water 100 thereby cooling the lubrication cooler 76. The intake duct 76 thus forms the fluid delivery system in this embodiment.

As common to each of the above-described embodiments, a generally dry sump type lubrication system is provided for the watercraft engine with a unique lubrication cooling system. The system includes a cooler which is placed in a flow of cooling fluid (either water or air). A fluid delivery system—such as, for example, an intake air device, an air or water tunnel, or a water jacket—can supply the cooling fluid. A portion of the cooler also can be arranged as an exterior of the watercraft to place the cooler in the flow path of cooling fluid. For each of these cases, the lubricant within the lubrication system is cooled in order to inhibit chemical breakdown of the lubricant.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A small watercraft comprising a hull with an engine compartment, an internal combustion engine mounted in the engine compartment and including a crankcase, a water propulsion device powered by the internal combustion engine, and a lubrication system including a pump device, a lubrication cooler and a reservoir, the lubrication system communicating with the engine so as to supply lubricant thereto with the pump device circulating lubricant between the engine, the lubrication cooler, and the reservoir, the reservoir being disposed apart from the crankcase of the engine.

2. The small watercraft of claim 1, wherein the hull comprises an upper portion and a lower portion, and the lubrication cooler is integrally disposed on the lower portion so as to place at least a portion of the lubrication cooler in contact with water with the watercraft residing in a normally upright position in a body of water.

3. The small watercraft of claim 2, wherein the lower portion of the hull comprises a ride plate, and the lubrication cooler is integrally disposed on the ride plate so as to place at least a portion of the lubrication cooler in contact with the water of a body of water in which the watercraft operates.

4. The small watercraft of claim 3, wherein the hull further comprises a pump chamber for the propulsion device and wherein the ride plate extends beneath at least the entire pump chamber.

5. The small watercraft of claim 2, wherein the lower portion of the hull comprises an intake duct for the propulsion device, and the lubrication cooler is integrally disposed in the intake duct so as to place at least a portion of the lubrication cooler in contact with the water of a body of water in which the watercraft operates.

6. The small watercraft of claim 2, wherein the lower portion of the hull comprises a pump chamber for the propulsion device, and the lubrication cooler is integrally disposed in the pump chamber so as to place at least a portion of the lubrication cooler in contact with the water of a body of water in which the watercraft operates.

7. The small watercraft of claim 1, wherein the propulsion device communicates with an intake duct, and the lubrication cooler is located at least partially in the intake duct to expose the portion of the lubricant cooler to a water flow through the water intake duct.

8. The small watercraft of claim 1 additionally comprising means for delivering a flow of a generally ambient fluid adjacent to at least a portion of the lubrication cooler.

9. The small watercraft of claim 1, wherein the lubrication cooler is integrated with the hull so that at least part of the lubrication cooler communicates with ambient water.

10. The small watercraft of claim 9, wherein the lubrication cooler is positioned in a ride plate.

11. The small watercraft of claim 10, wherein the hull comprises a pump chamber for the propulsion device and wherein the ride plate extends beneath at least the entire pump chamber.

12. The small watercraft of claim 9, wherein the lubrication cooler is positioned behind a bulkhead.

13. The small watercraft of claim 9, wherein the lubrication cooler is positioned within a tunnel of the propulsion device.

14. The small watercraft of claim 1 additionally comprising a fluid delivery device for delivering a cooling fluid next to at least a portion of the lubrication cooler.

15. The small watercraft of claim 14, wherein the fluid delivery device comprises an intake duct which communicates with water propulsion device.

16. The small watercraft of claim 1, wherein the hull comprises an upper deck portion and a lower hull portion, and the lubrication cooler is located in the upper deck portion in a position exposing the lubrication cooler to a fluid flow.

17. The small watercraft of claim 16, wherein the hull includes an intake chamber arranged toward a bow of the watercraft, and the lubrication cooler is located within the intake chamber.

18. The small watercraft of claim 1, wherein the lubrication cooler is located within a water jacket.

19. The small watercraft of claim 18, wherein the water jacket communicates with the propulsion device.

20. The small watercraft as in claim 18, wherein the water jacket communicates with an engine cooling system.

21. A small watercraft comprising a water propulsion device powered by an internal combustion engine, the engine mounted in an engine compartment of a hull, a lubrication system that supplies lubricant to the engine, the lubrication system including a pump device that circulates lubricant between the engine and a lubrication cooler, the lubrication cooler located within a water jacket.

22. The small watercraft of claim 21, wherein the water jacket communicates with the propulsion device.

23. The small watercraft of claim 22, wherein the water jacket is positioned above the propulsion device.

24. The small watercraft of claim 22, wherein the water jacket further communicates with an ambient water.

25. The small watercraft of claim 22, wherein the water jacket further communicates with an engine cooling system.

26. The small watercraft of claim 21, wherein the water jacket communicates with an engine cooling system.

27. The small watercraft of claim 26, wherein the water jacket is positioned above the engine.

28. The small watercraft of claim 26, wherein the water jacket further communicates with the ambient water.

29. The small watercraft of claim 26, wherein the water jacket further communicates with the propulsion unit.

30. The small watercraft of claim 29, wherein the water jacket is positioned above the propulsion device.

31. A small watercraft comprising a water propulsion device powered by an internal combustion engine, the engine mounted in an engine compartment of a hull, the hull comprising an upper portion and a lower portion, a lubrication system that supplies lubricant to the engine, the lubrication system including a pump device that circulates lubricant between the engine and a lubrication cooler, the lubrication cooler located in the upper portion in a position exposing the lubrication cooler to a fluid flow.

32. The small watercraft of claim 31, wherein the hull includes an intake chamber arranged toward a bow of the watercraft, and the lubrication cooler is located within the intake chamber.

33. The small watercraft of claim 32 additionally comprising an air duct placing the engine compartment in communication with the intake chamber, the intake chamber including an inlet opening arranged to permit a flow of air into the intake chamber, and the lubrication cooler being positioned within the intake chamber between the inlet opening and the air duct.

34. The small watercraft of claim 33 additionally comprising a water drainage mechanism connected to the intake chamber.

35. The small watercraft of claim 32, wherein the intake chamber is located toward one side of the hull.

36. The small watercraft of claim 35, wherein the hull is defined between the bow and a stern, and between a pair of sides, and the intake chamber includes a generally front-facing inlet opening and a generally side-facing outlet opening.

37. A small watercraft comprising a water propulsion device powered by an internal combustion engine, the engine mounted in an engine compartment of a hull, a lubrication system that supplies lubricant to the engine, the lubrication system including a pump device that circulates lubricant between the engine and a lubrication cooler, the lubrication cooler being integrated with the hull so that at least part of the lubrication cooler communicates with ambient water, the lubrication cooler positioned in a tunnel that communicates with the water propulsion device.

38. A small watercraft comprising a water propulsion device powered by an internal combustion engine, the engine mounted in an engine compartment of a hull, a lubrication system that supplies lubricant to the engine, the lubrication system including a pump device that circulates lubrication between the engine and a lubrication cooler, and a fluid delivery device for delivering a cooling fluid next to at least a portion of the lubrication cooler, the fluid delivery device having an air intake chamber in the hull arranged to channel ambient air over the lubrication cooler.

39. A small watercraft comprising a water propulsion device powered by an internal combustion engine, the engine mounted in an engine compartment of a hull, a lubrication system that supplies lubricant to the engine, the lubrication system including a pump device that circulates lubrication between the engine and a lubrication cooler, and a fluid delivery device for delivering a cooling fluid next to at least a portion of the lubrication cooler, the fluid delivery device having a water jacket located above the propulsion device and arranged to contact at least a portion of the lubrication cooler, the water jacket communicating with the propulsion unit.

40. The small watercraft of claim 39, wherein the water jacket comprises a port which communicates with an engine cooling system.

41. A small watercraft comprising a hull with an engine compartment, an internal combustion engine mounted within the engine compartment and including a crankcase, a propulsion device powered by the internal combustion engine, a lubrication system including a pump and a reservoir, a lubrication system communicating with the engine so as to supply lubricant to the engine with the pump circulating lubricant between the engine and the reservoir, the reservoir being disposed apart from the crankcase of the engine, and means for cooling lubricant within the lubrication system.

* * * * *